US005256948A

United States Patent [19]

Boldin et al.

[11] Patent Number: 5,256,948

[45] Date of Patent: Oct. 26, 1993

[54] TRI-COLOR FLASHER FOR STRINGS OF DUAL POLARITY LIGHT EMITTING DIODES

[76] Inventors: Charles D. Boldin, 5115 Pine Knob La., Clarkston, Mich. 48346; Maurice R. Carter, 2801 Maplewood Rd., Richmond, Va. 23228

[21] Appl. No.: 863,714

[22] Filed: Apr. 3, 1992

[51] Int. Cl.[5] ..... H05B 37/00; 315 159; 315 200 A; 315 313; 315 314; 315 315; 315 360; 315 362; 315 185 S; 315 193

[52] U.S. Cl. ..... 315/313; 315/200 A; 315/185 S

[58] Field of Search ..... 315/159, 200 A, 313, 315/314, 315, 360, 362, 185 S, 193

[56] References Cited

U.S. PATENT DOCUMENTS 4,420,711 12/1983 Takahashi et al. ..... 315/201 X
4,675,575 6/1987 Smith et al. ..... 315/185 S

*Primary Examiner*—Steven Mottola

[57] ABSTRACT

An electronic flasher producing various waveforms with user-controllable time durations, connected to a decorative string of dual-polarity dual-color light emitting diodes, in order to generate a controllable sequence of colors with interspersed OFF periods.

9 Claims, 2 Drawing Sheets

| OPERATING SCENARIO | | | | |
|---|---|---|---|---|
| CLOCK CYCLE | COUNTER OUTPUT BI BO | DECODER OUTPUT | DUAL XNOR OUTPUTS | LAMP * COLOR |
| 1 | 0 0 | DO | DO | RED |
| 2 | 0 1 | DI | DI | YELLOW |
| 3 | 1 0 | D2 | DO & DI | ORANGE |
| 4 | 0 0 | DO | DO | RED |
| 5 | 0 1 | DI | DI | YELLOW |
| 6 | 1 0 | D2 | DO & DI | ORANGE |
| . . | | | | |

* ASSUMING DUAL COLOR RED/YELLOW LEDs

TRI-COLOR FLASHER FOR STRINGS OF DUAL POLARITY LIGHT EMITTING DIODES

BACKGROUND OF THE INVENTION

This invention relates to an electronic cycling switch or flasher for a series string of light emitting diodes (LED) which are dual polarity to flash a different color on each of the flashers outputs of three waveforms. Devices of the type according to the invention are generally used in connection with decorative lights, such as Christmas tree lights, to cause the LED's to flash and twinkle in various patterns. The prior art contains a number of cycling flashers, for example, U.S. Pat. No. 4,420,711 to Takahashi which discloses a control circuit for LED's to produce different color emission. The patent recognizes the effect of a cycling flasher emitting various voltages, frequencies and pulse widths to LEDs, but it does not disclose the cycling flasher of the instant invention which produces various waveforms, including positive and negative-going D.C. pulses, sinosoidal (A.C.).

The U.S. Pat. No. 4,675,575 to Smith et al. discloses a LED Christmas tree lighting system wherein various AC and DC control circuit are provided to drive the LEDs to emit three colors and intensity. This patent addresses the function of the instant invention, but is far more complex.

SUMMARY OF THE INVENTION

Briefly the instant invention overcomes the disadvantages of the prior art flashers for decorative strings of LEDs by providing an electronic cycling flasher that will cause strings of dual-polarity light emitting diodes (LEDs) to flash a different color on each of the three cycles of emitted waveforms.

The flasher according to the instant invention is connected to the conventional 120 VAC outlet in the home for a power source. The current required is very low and therefor provides energy savings proportional to the on/off duty cycle of the lights. The flasher has user-accessible controls so that the rate of flash and the on/off cycle time between flashes may be varied to suit the user's taste and mood. Also the flasher can be adjusted by the user to output to the dual polarity LEDs, various voltages, various frequencies, and polarities to produce various effects and colors.

STATEMENTS OF THE OBJECTS OF THE INVENTION

Accordingly an object of this invention is to provide a flasher for controlling decorative strings of LEDs to flash the different colors of red, green and orange on each of three cycles produced by the flasher.

Another object of the invention is to provide a flasher for controlling strings of decorative lights that is user-controlled to provide various effects of flashing and twinkling by varying the rate of flash and "off" time.

A further object of the instant invention is to provide a simple and energy-conserving electronic flasher for decorative light strings.

A still further object of the search is to provide an electronic circuit to produce pulsating direct current (D.C.) in one polarity and then the other polarity and then alternating current (A.C.) to a string of two-color dual-polarity LEDs causing them to illuminate sequentially in three different colors of red, green and orange.

BRIEF DESCRIPTION OF THE DRAWING

These and other objects, advantages and novel features of the instant invention will become apparent from the following detailed description of the instant invention when considered in conjunction with the accompanying drawings wherein.

DESCRIPTION OF THE PREFERRED EMBODIMENT

Figures 1, 3:
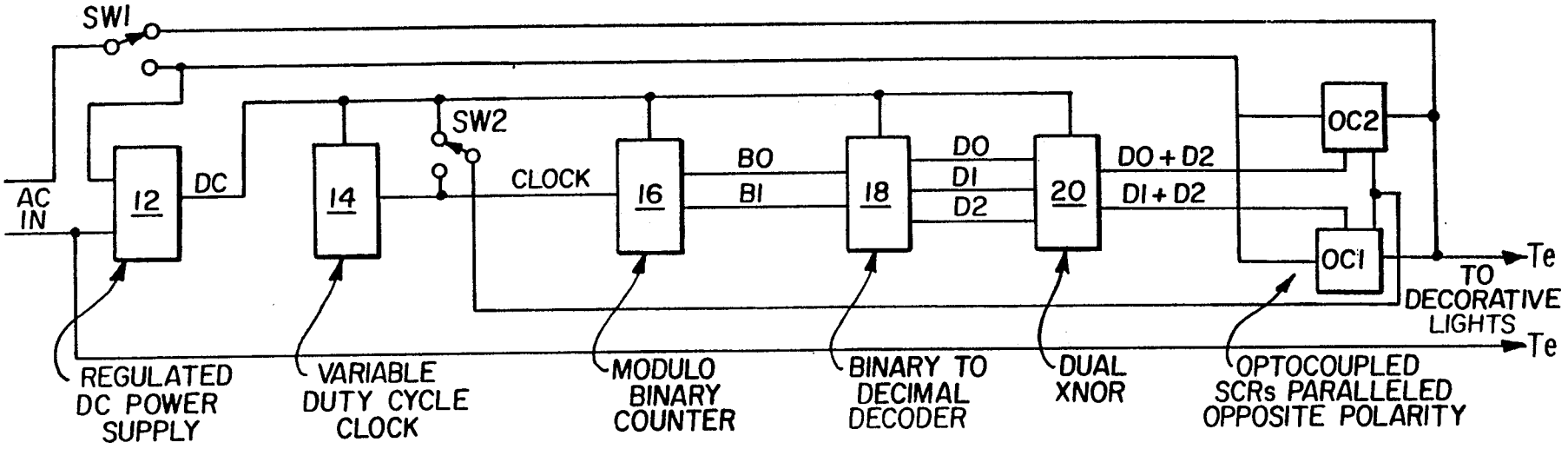
FIG. 1 is a block diagram showing the functions of the modules of the flasher circuit.
FIG. 3 is a table showing the operating scenario of the output produced by the flasher.

Referring now to the drawings, wherein like reference numerals refer to like items throughout the several views, there is shown generally in FIG. 1 a block diagram of the tri-color flasher device 10. A block diagram of the modules is used to explain the principle of the operation that produces the various waveforms so that the LED's emit the different colors.

Switch 1 is the power on/off switch. It also bypasses the flasher into the OFF position so the lights will light continuously without flashing. Switch 2 selects whether or not there will be an OFF or dark period between flashes.

Block 12 is a DC regulated power supply which converts the 120 VAC input voltage to a lower DC regulated output voltage of perhaps 12–14 VDC which then supplies the operating power to the flasher device's electronic circuitry.

Block 14 is a variable duty-cycle clock which incorporates two user accessible potentiometers where one controls the ON time and the other controls the OFF time of the clock's square wave output.

Block 16 is a modulo 3 binary counter which output is either 00, 01, or 10, thus changing in unison with the clock's square wave.

Block 18 is a binary-to-decimal decoder where a 00 input causes an output at D0; an input of 01 causes an output at D1; and an input of 10 causes an output at D2.

Block 20 is a dual XNOR (exclusive NOR) gate where either D0 or D2 causes an output to opto-coupler OC 2 and either D1 or D2 causes an output to opto-coupler OC 1.

Blocks OC 1 and OC 2 are optocouplers having silicon controlled rectifier (SCR) controlled by an LED optocoupler OC 1 wired in parallel with optocoupler OC 2 with opposing polarities, that is the SCR sections of the optocouplers are connected cathode to anode and anode to cathode. The input LED sections of these optocouplers are connected so that one XNOR output causes SCR of OC 1 to turn on and another XNOR output causes SCR OC 2 to turn on.

In the following example, assume that a string of dual polarity red/yellow LEDs are connected at terminals Term. When SCR of OC 1 is turned on, the 120 VAC input current is half-wave rectified causing a pulsating direct-current (PDC) to be applied to the dual polarity LED decorative lights causing them to illuminate red. When SCR of OC 2 is turned on the 120 VAC input current is also half-wave rectified, but in the opposite polarity causing a PDC to be applied to the decorative LEDS, this time causing them to illuminate yellow. When both OC 1 and OC 2 are both turned on at the same time, an altermating current (A.C.) is applied to the decorative LEDs causing both the red and the yellow elements to illuminate thus appearing orange.

Figure 2:
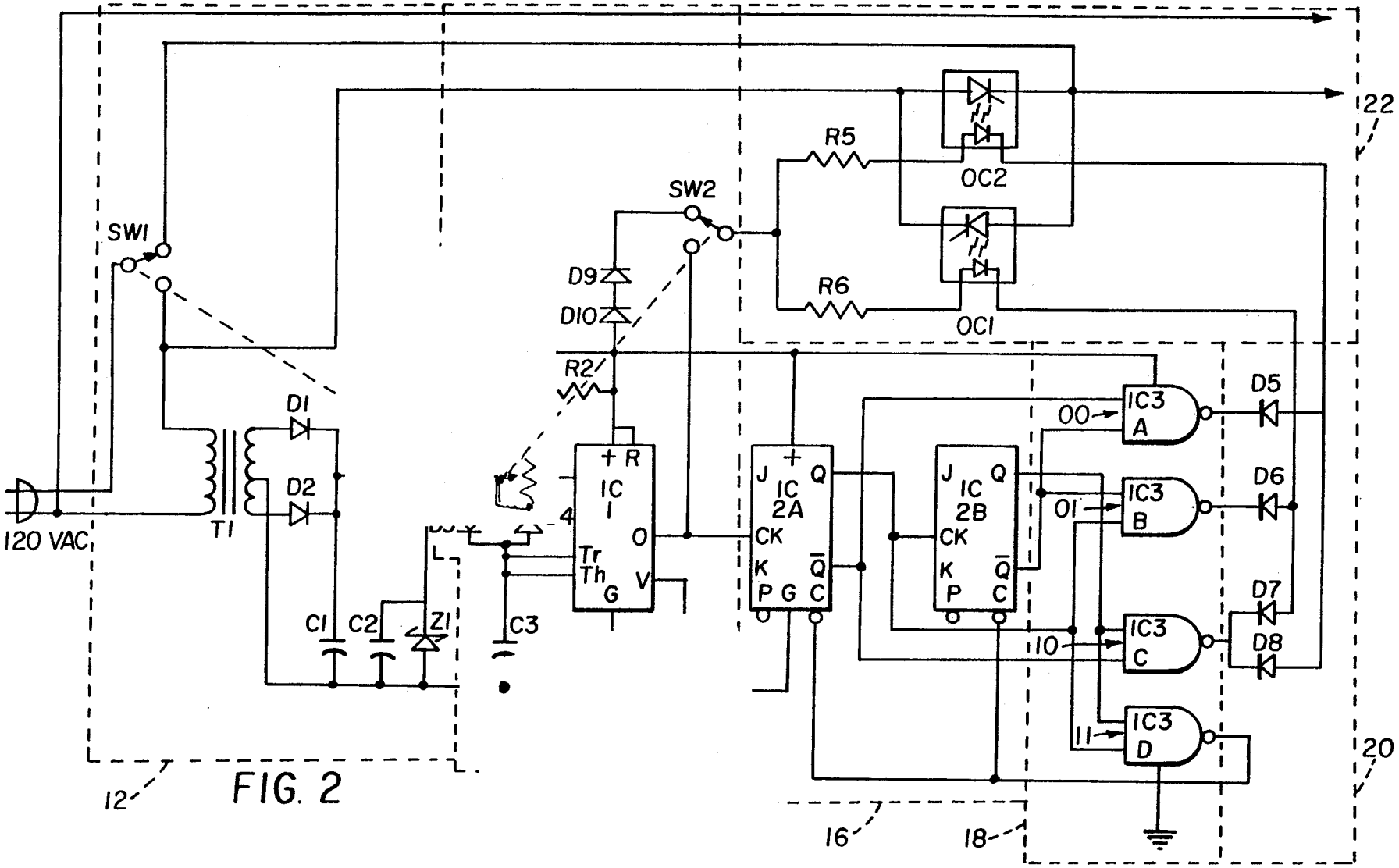
FIG. 2 is an electronic schematic diagram of the flasher and the details of the modules.

Referring now to FIG. 2 there is shown a schematic diagram of the preferred embodiment of this invention. A regulated power supply 12 and its associated circuitry comprise a step-down transformer T1 with a center-tapped secondary which steps down 120 VAC to 12.6 VAC. Diodes D1 and D2 are connected for full-wave rectification converting the alternating current to pulsating direct current. A filter capacitor C1 removes the AC ripple to produce a smooth direct current output. A current limiting resistor, R1 connects the direct current output to Z1, a 5 volt zener diode, which regulates the power supply's output to a constant 5 volts. C2 is a bypass capacitor which stabilizes the regulator circuit and prevents any self oscillation that may occur.

The clock 14 and its associated circuitry are also shown in FIG. 2 comprising an integrated circuit timer 1C1, the output of which is a square wave controlled by capacitor C3 which is the clock timing capacitor. Diode D3 in series with potentiometer R3 to control the charge time of C3 when the clock output is high, which combination also controls the length of the time that the clock output remains high.

Referring again to FIGS. 1 and 2, the operation of the clock is as follows. Potentiometer R3 and SW1 are ganged together so that rotating R3 fully CCW turns off the entire flasher. Diode D4 causes potentiometer R4A and fixed resistor R4B to control the discharge time of C3 while the clock output is low, which C3 in turn controls the length of time that the clock output remains low. Potentiometer R4A and SW2 are ganged together so that when R4A is fully CCW, the OFF (or dark) time of the decorative LEDs is eliminated. A fixed timing resistor R2 sets the low range of pot R3 while fixed resistor R4B sets low range of pot R4A the variable timing resistor. A bypass capacitor C4 connected to the IC timer merely bypasses spikes to ground.

Also shown in FIG. 2 is a binary counter module 16 and its associated circuitry. The counter comprises integrated circuits IC2A and IC2B which are dual JK flip flops connected as a sequential counter. Integrated circuit IC 3D is a NAND gate and detects the counters inherent "4th sequence", causing a reset, so the counter only counts to three.

The binary to decimal decoder 18 and its associated circuitry are shown in detail in FIG. 2 as follows: The decoder comprises IC3 which is a quad NAND gate integrated circuit having Gates A, B, C and D. Gate A detects counter output 00 which causes gate A output to go low. Gate B detects 01 from the counter causing gate B output to go low. Gate C detects 10 from the counter causing Gate C output to go low. Gate D detects 11 from the counter immediately causing a counter reset to 00 thus the counter counts to only three as discussed above.

The dual XNOR (exclusive NOR) section 20 and its associated circuitry are shown in FIG. 2 as follows. The XNOR function is performed by diodes D5, D6, D7 and D8, the outputs of which are fed to a dual optocoupler section with the following effect: A low output from 1C gate 3A forward biases D5 which turns on the LED of optocoupler OC1. Likewise, a low output from 1C gate 3B forward biases D6 which turns on the LED of optocoupler OC2. Further a low output from 1C gate 3C forward biases D7 and D8 which then turns on both LEDs of optocouplers OC1 and OC2.

The dual optocouplers and the associated circuitry is shown in FIG. 2 as follows: The optocouplers OC1 and OC2 are silicon controlled rectifiers (SCRS) triggered by light emitting diodes. Resistors R5 and R6 limit the current to the input of LEDs of the OCs. Diodes D9 and D10 further limit this current when S2 is activated to eliminate the decorative LEDs dark time. The appropriate voltage is fed to the SCR sections of the optocouplers to control the decorative lights.

Referring now to FIG. 3 of the drawings there is shown a table depicting the operating scenario of the electronic flasher to produce the tri-color effect of a string of decorative LEDs. For example, when the clock 14 is performing cycle 1, the binary counter 16 outputs code "00" causing the dual-color (red/yellow) LEDs to emit the color red. The binary counter 16 outputs are processed by the intervening binary-to-decimal decoder 18 and the dual XNOR 20. As will be understood by those skilled in the art, the clock cycles from cycle 1 to cycle 6 to emit the various wave-form outputs to cause the string of decorative LEDs to emit the various colors as shown in the scenerio table.

Obviously many modifications and variations of the instant invention are possible in light of the above teachings. For example, the user accessible controls may vary the rate of flash and off-time of the flashes. It is therefore to be understood that within the scope of the appended claims, the invention may be practiced otherwise than as specifically described.

What is claimed as new and desired to be secured by Letters Patent is:

1. An electronic control unit connectable to a source of AC power for driving a string of dual-polarity dual-color LEDs to produce a sequential plurality of colors, comprising:

clock means to generate a plurality of timing pulses;

counting means receiving said timing pulses and producing a plurality of binary signals establishing a plurality of sequential states;

decoding means receiving said plurality of binary signals and actuating selected output lines corresponding to said binary signals and to said plurality of sequential states;

waveform conversion means receiving said selected output lines and generating control signals capable of selectively controlling a plurality of optocouplers according to said plurality of sequential states;

a plurality of optocouplers having their controlled path operatively connected with differing AC conduction characteristic between said source of AC power and said string of LEDs, and their controlling input operatively connected to said waveform conversion means for selectively providing power to said LEDs according to said plurality of sequential states;

whereby the combined conduction through said plurality of optocouplers between said source of AC power and said string of LEDs establishes a plurality of differing AC conduction characteristics during each of said plurality of sequential states; thereby producing a sequential plurality of colors in said string of LEDs.

2. The electronic control unit of claim 1, wherein said clock means provides timing pulses having variable duration characteristics.

3. The electronic control unit of claim 1, wherein said waveform conversion means includes means to receive said timing pulses; and said generated control signals include at least one OFF state wherein no AC power is applied to said string of LEDs.

4. The electronic control unit of claim 1, wherein said decoding means comprises digital logic means connected to perform a decoding function, and said waveform conversion means comprises a plurality of diodes connected to provide a plurality of logical functions combining selected ones of said selected output lines to effect emmission of a desired sequential plurality of colors in said string of LEDs.

5. An electronic control unit connectable to a source of AC power for driving a string of dual-polarity dual-color LEDs to produce a sequential plurality of colors and OFF periods, comprising:

clock means to generate a plurality of timing pulses;

counting means receiving said timing pulses and producing a plurality of binary signals establishing a plurality of sequential states;

decoding means receiving said plurality of binary signals and actuating selected output lines corresponding to said binary signals and to said plurality of sequential states;

waveform conversion means receiving said selected output lines and said timing pulses and generating control signals capable of selectively controlling a plurality of optocouplers according to said plurality of sequential states;

a plurality of optocouplers having their controlled path operatively connected with differing AC conduction characteristic between said source of AC power and said string of LEDs, and their controlling input operatively connected to said waveform conversion means for selectively providing power to said LEDs according to said plurality of sequential states;

whereby the combined conduction through said plurality of optocouplers between said source of AC power and said string of LEDs establishes a plurality of differing AC conduction characteristics during each of said plurality of sequential states; thereby producing a sequential plurality of colors and OFF periods in said string of LEDs.

6. The electronic control unit of claim 5, wherein said clock means provides timing pulses having variable duration characteristics.

7. The electronic control unit of claim 5, wherein said decoding means comprises digital logic means connected to perform a decoding function, and said waveform conversion means comprises a plurality of diodes and resistors connected to provide a plurality of logical functions combining selected ones of said selected output lines and said timing pulses to effect emmission of a desired sequential plurality of colors and OFF periods in said string of LEDs.

8. An electronic control unit connectable to a source of AC power for driving a string of dual-polarity dual-color LEDs to produce a sequence of variable duration colors and OFF periods by said LEDs, comprising:

clock means to generate a plurality of timing pulses of variable duration;

counting means receiving said timing pulses and producing a plurality of binary signals establishing a plurality of variable duration sequential states;

decoding means receiving said plurality of binary signals and actuating selected output lines corresponding to said binary signals and to said plurality of variable duration sequential states;

waveform conversion means receiving said selected output lines and timing pulses and generating control signals capable of selectively controlling a plurality of optocouplers according to said plurality of variable duration sequential states;

a plurality of optocouplers having their controlled path operatively connected with differing AC conduction characteristic between said source of AC power and said string of LEDs, and their controlling input operatively connected to said waveform conversion means for selectively providing power to said LEDs according to said plurality of variable duration sequential states;

whereby the combined conduction through said plurality of optocouplers between said source of AC power and said string of LEDs establishes a plurality of differing AC conduction characteristics during each of said plurality of variable duration sequential states; thereby producing a sequence of variable duration colors and OFF periods by said string of LEDs.

9. The electronic control unit of claim 8, wherein said decoding means comprises digital logic means connected to perform a decoding function, and said waveform conversion means comprises a plurality of diodes and resistors connected to provide a plurality of logical functions combining selected ones of said selected output lines and timing pulses to effect emmission of a desired sequential plurality of colors and OFF periods with variable duration in said string of LEDs.

* * * * *